US006498545B1

(12) United States Patent
Levi

(10) Patent No.: US 6,498,545 B1
(45) Date of Patent: Dec. 24, 2002

(54) PHASE CONTROL DEVICE

(75) Inventor: Shem-Tov Levi, Beit-Hanan (IL)

(73) Assignee: Skygate International Technology NV, Curacao ( * ) Notice: Subject to any disclaimer, the term of this patent is extended or adjusted under 35 U.S.C. 154(b) by 0 days.

(21) Appl. No.: 09/230,267

(22) PCT Filed: Jul. 25, 1996

(86) PCT No.: PCT/IL96/00066

§ 371 (c)(1),
(2), (4) Date: Dec. 20, 1999

(87) PCT Pub. No.: WO98/05089

PCT Pub. Date: Feb. 5, 1998

(51) Int. Cl.[7] ..... H01P 1/18; H01P 3/00
(52) U.S. Cl. ..... 333/156; 333/164; 333/161
(58) Field of Search ..... 333/156, 164, 333/161; 323/212, 213

(56) References Cited

U.S. PATENT DOCUMENTS 4,586,047 A 4/1986 Inacker et al.
4,633,256 A 12/1986 Chadwick
4,731,614 A 3/1988 Crane
4,806,944 A 2/1989 Jacomb-Hood
4,811,032 A 3/1989 Boksberger et al.
5,337,027 A * 8/1994 Namordi et al. ..... 333/161
5,457,465 A 10/1995 Collier et al.

FOREIGN PATENT DOCUMENTS

EP 0266567 5/1988

OTHER PUBLICATIONS

Ivanova, Olga Nikolaevna; Electronic Communication; Svjaz, pp. 18, 39–41. 45–46, 49, 220, 225, 276 (1971) w/translation.

* cited by examiner

*Primary Examiner*—Robert Pascal
*Assistant Examiner*—Kimberly E Glenn
(74) *Attorney, Agent, or Firm*—Browdy and Neimark

(57) ABSTRACT

A phase control device, for providing a plurality of phase values, for utilization by any system having a number of input/output ports with signals requiring control of their relative phases. The phase control device is constructed from phase shift elements electrically connected to a system of electrically interconnected switches separated off from the phase shift elements. The result is a reduction in the number of phase shift elements and switches as compared to conventional phase shifters and a simplification of the resulting architecture, a feature of significant importance in chip miniaturization.

22 Claims, 8 Drawing Sheets

PHASE CONTROL DEVICE

FIELD OF THE INVENTION

The present invention relates to phase control devices in general and phase control devices as applied to phased array antennas in particular.

BACKGROUND OF THE INVENTION

Phase control devices play an important role in radar and communications in general, and in satellite communications in particular. There are known in the art, planar phased array antennas for communicating with satellites which are mountable on moving platforms. For certain of such applications the planar phased array antenna may comprise several hundred radiating elements. This results in the use of a corresponding several hundred phase shifters, one for each radiating element. Owing to the large number of phase shifters required, the phased arrays themselves are therefore expensive.

There is, therefore, a need for reducing the number of phase shifters required for a given number of radiating elements of a phased array.

SUMMARY OF THE INVENTION

In the following description and claims reference is made to phase shifters and to phase control devices as applied to phased array antennas. This is done for clarity of illustration only and should in no way be interpreted as a limiting property of the phase control devices of the invention which can be utilized by any system having a plurality of input/output ports with signals requiring control of their relative phases.

In referring to phase shifters reference is implicitly made to the phase shift elements and switches constituting the phase shifters; hence reducing the number of phase shifters required for a given task implies reducing the number of constituent phase shift elements and switches.

It is an object of the present invention to provide a phase control device which reduces the number of phase shifters required in a given application as compared to prior art techniques. In addition to the reduction in the number of phase shift elements and switches, another object of the present invention is the simplification of the resulting architecture wherein the reduced number of phase shift elements is separated off from the reduced number of switches, a feature of significant importance in chip miniaturization.

In accordance with the present invention there is provided a phase control device for providing a plurality of phase values, comprising:

- a plurality of electrically interconnected phase shift elements; and
- a plurality of switches electrically interconnected by a plurality of first conducting lines and a plurality of second conducting lines, said plurality of switches electrically connected to said plurality of phase shift elements by means of said plurality of second conducting lines.

If desired the phase shift elements and the switches may be partitioned into phase control units, the phase shift elements in each phase control unit being electrically interconnected and the switches in each phase control unit being electrically interconnected, only to switches within the same phase control unit and to the phase shift elements thereof.

Further, if desired, all the phase control units are parallelly connected.

Optionally, all the phase control units are serially connected.

Alternatively, some of the phase control units are serially connected whereas others are parallelly connected.

Also, if desired, the phase control units may be connected to the switches of a further phase control unit.

In a specific application of the invention the phase shift elements, the switches and the first conducting lines are disposed on one side of a dielectric plate; whereas the second conducting lines are disposed on the opposite of said dielectric plate.

In accordance with one embodiment of the present invention the phase control device further comprises, in a piecewise layered formation, a plurality of dielectric plates, each having front and rear faces, and wherein said plurality of phase shift elements, said plurality of first conducting lines and said plurality of second conducting lines are disposed on the faces of said dielectric plates.

In accordance with one embodiment of the invention the phase shift elements are serially connected.

In accordance with another embodiment of the invention the phase shift elements are parallelly connected.

BRIEF DESCRIPTION OF THE DRAWINGS

For a better understanding, the invention will now be described, by way of a non-limiting example only, with reference to the accompanying drawings in which.

DETAILED DESCRIPTION OF PREFERRED EMBODIMENTS

Figure 1:
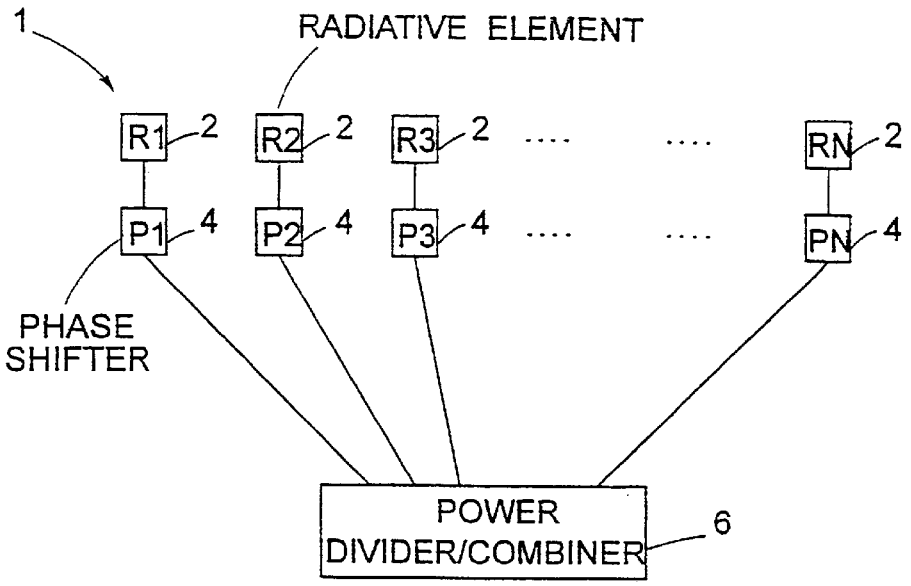
FIG. 1 shows an illustrative block diagram of a phased array antenna with each radiating element connected to a phase shifter.

Attention is first drawn to FIG. 1, showing an illustrative block diagram of a phased array antenna 1, comprising N radiating elements 2, designated by RI (I-1, . . . , N), each connected via a corresponding phase shifter 4 to a power divider/combiner 6. Since there is a phase shifter connected to each radiating element there are N phase shifters, designated by PI (I=1, . . . , N).

Figure 2:
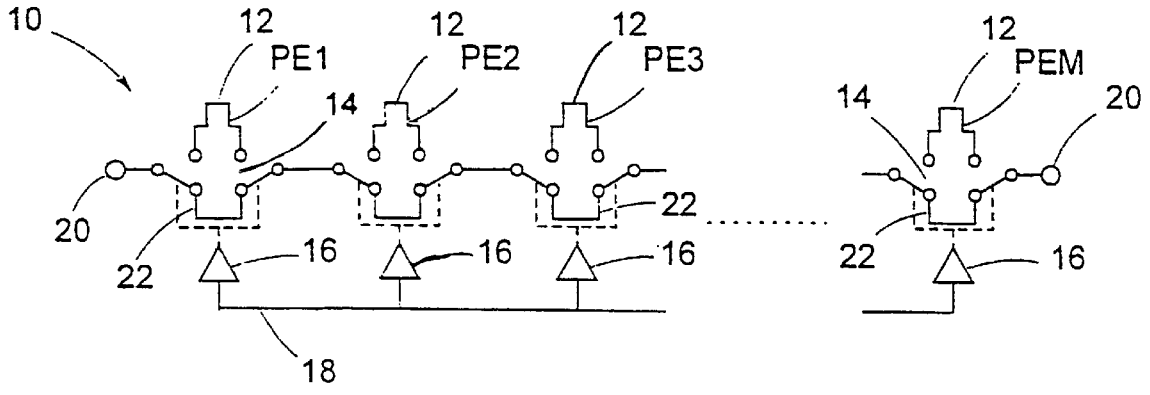
FIG. 2 shows a typical M-stage phase shifter.

FIG. 2 shows a typical multi-stage M-stage phase shifter 10, comprising M phase shift elements 12, designated by PEJ (J=1, . . . , M), reference elements 22. switches 14 for introducing either the phase shift elements or the reference elements into the electrical path between the input/output ports 20, control units 16, for operating the switches and a control bus 18 connected to the control units. Each phase shift element 12 introduces a different phase shift in the current flowing through it in relation to a current flowing through a corresponding one of the reference elements 22.

Figure 3A:
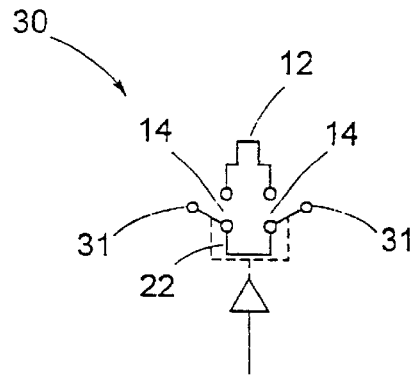
FIG. 3*a* shows a single phase shifter of an M-stage phase shifter in the "off" state.
Figure 3B:
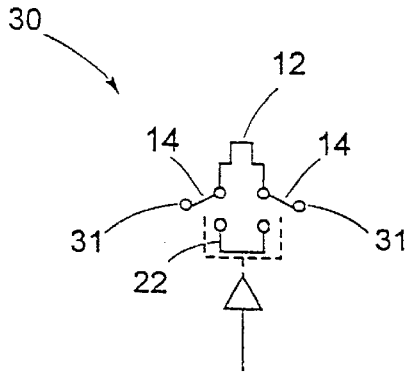
FIG. 3*b* shows a single phase shifter of an M-stage phase shifter in the "on" state.

FIG. 3*a* shows a single phase shifter 30 of a multi-stage phase shifter, of the type shown in FIG. 2, in the "off" state, wherein a certain phase is introduced in a current flowing through the reference element 22. The current enters and exits the switch through the switch's input/output ports 31. On the other hand, FIG. 3*b* shows the single phase shifter 30 in the "on" state, wherein a different phase is introduced in the current flowing through the phase shift element 12. The single phase shifter 30 comprises two input and two output switches 14, either of which can serve as the input switch or the output switch since the phase shifter is bi-directional.

Figure 4A:
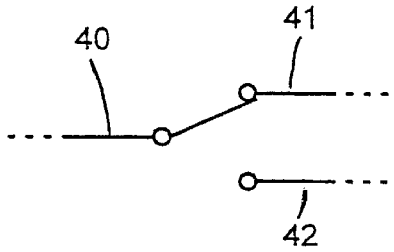
FIGS. 4*a* and 4*b* illustrate the terminology for counting the number of switches.
Figure 4B:
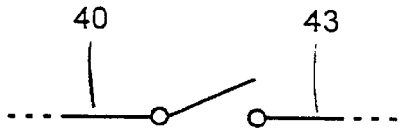

The terminology for counting the number of switches is illustrated in FIGS. 4*a* and 4*b*. In FIG. 4*a*, there are two switches, since circuit 40 can be brought into electrical connection with two circuits 41 and 42, whereas in FIG. 4*b*, there is only a single switch since circuit 40 can be brought into electrical contact with only a single circuit 43. In a unidirectional phase shifter the number of switches can be reduced by replacing its two output switches with a balanced combiner but this results in losses within the combiner. However, a unidirectional phase shifter, when used in bi-directional applications, adds at least two switches external to the phase shifter (see, for example, British Patent No. 2158997 A). On the other hand, in some implementations, such as in a low-pass high-pass phase shifters, there are as many as six switches. Hence, in general, phase shifters of interest can have all in all two to six switches. In the following description, phase shifters having four switches will be considered.

Returning to the M-stage phase shifter shown in FIG. 2, it is clear that it contains a total of 4M switches. The number of phase combinations P obtainable from an M-stage phase shifter is given by $P=2^M$. This relation can be derived by counting the number of combinations of "on" and "off" states of the M single phase shifters comprising the M-stage phase shifter. Hence, in a phased array antenna, whether it be linear or planar, comprising N separately controlled radiating elements, each connected to an M-stage phase shifter, there are a total of 4MN switches and MN phase shift elements. Furthermore, each M-stage phase shifter provides $2^M$ phase values, giving a total of $2^M$N phase values for the whole antenna. In phased array antennas in general, and microwave and millimeter wave phased array antennas in particular, there are a large number of radiating elements and a correspondingly large number of phase shifters. A large number of phase shifters (in the above example N M-stage shifters) not only results in the antenna being expensive, but also introduces a redundancy in the design of the phased array owing to the presence of a large number of identical phase shift elements.

The present invention reduces the number of switches and phase shift elements required for a given phased array antenna by providing one set of phase shift elements that are shared by all the radiating elements. This is attained by connecting the set of phase shift elements to a system of switches which in turn is connected to the radiating elements of the phased array antenna.

Figure 5:
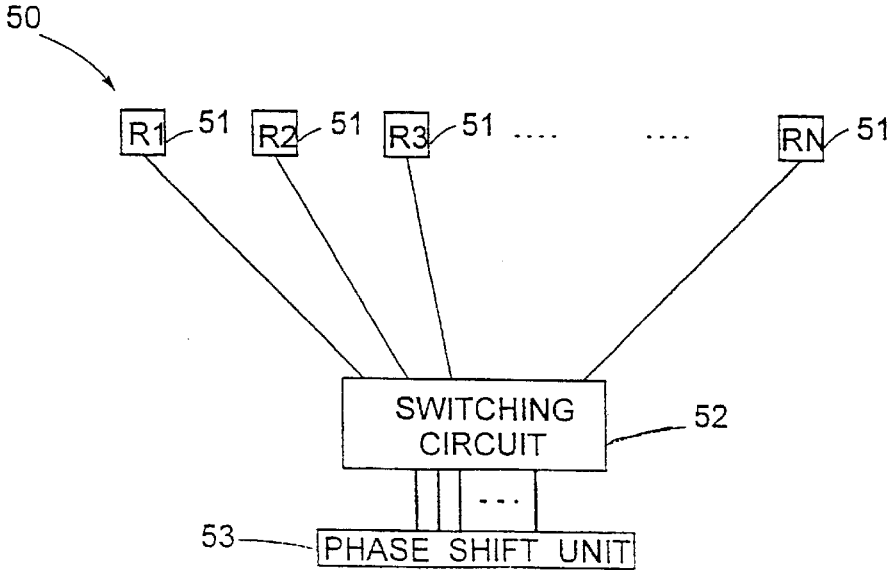
FIG. 5 shows an illustrative block diagram of a phased array antenna with a switching circuit and a phase shift unit.
Figure 6:
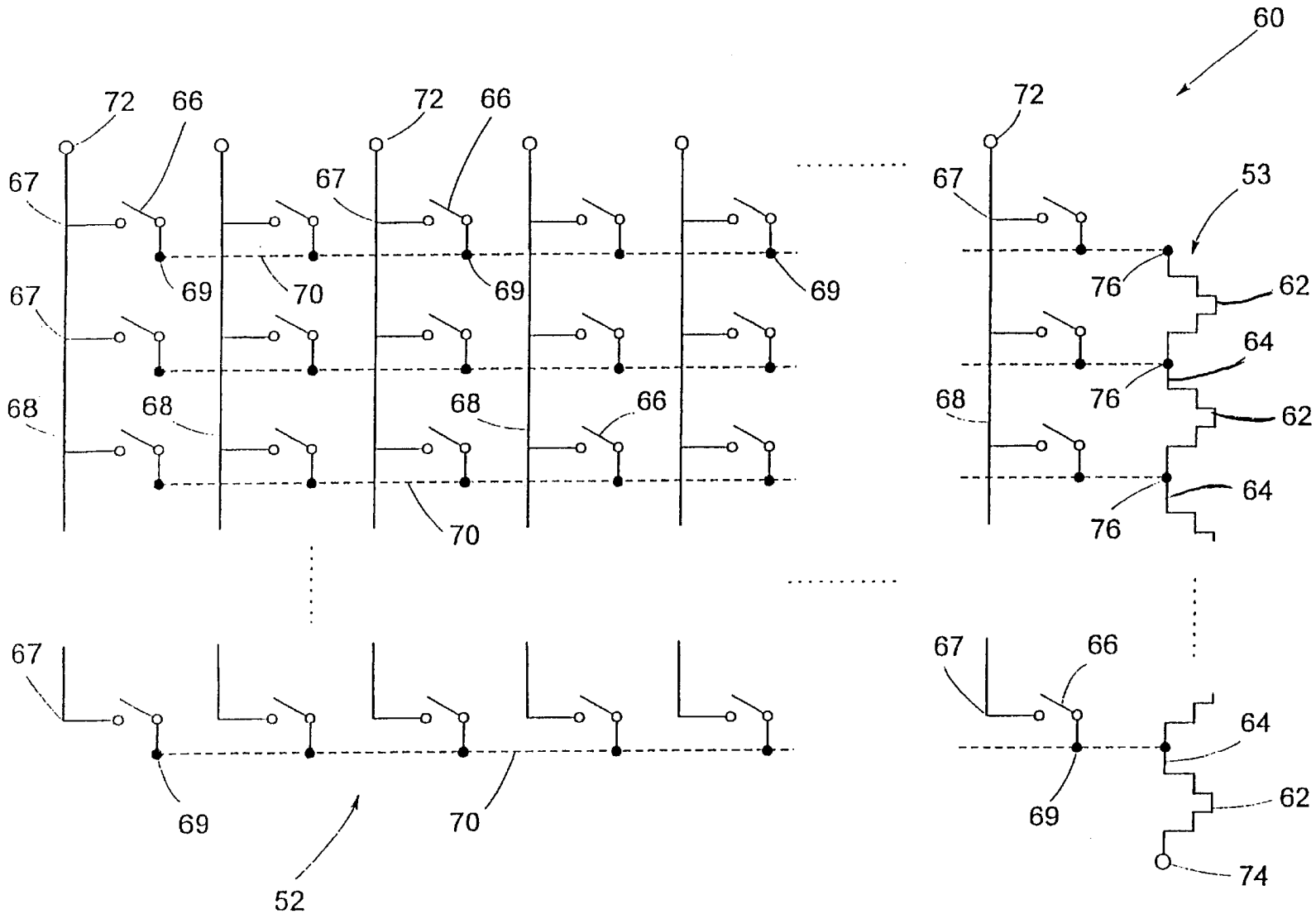
FIG. 6 illustrate the structure of a phase control device.

Attention is now drawn to FIG. 5 showing an illustrative block diagram of a phased array antenna 50, comprising N radiating elements 51, designated by RI (I=1, . . . , N), connected each to a switching circuit 52 which is in turn connected to a phase shift unit 53. The switching circuit 52 and the phase shift unit 53 taken together, constitute the phase control device of the invention. FIG. 6 illustrates the structure of the phase control device 60 in accordance with one embodiment of the invention. The phase shift unit 53, in accordance with this embodiment, comprises a plurality of phase shift elements 62 serially connected by conducting lines 64. It should be noted that the phase shift elements 62 can be any suitable passive or active components or combinations thereof. The switching unit 52 comprises a plurality of switches 66, connected on one side, at first terminals 67, to a plurality of first conducting lines 68 and on the other side, at second terminals 69, to a plurality of second conducting lines 70 shown as broken lines in the figure. It should be noted that in the figure the first terminals 67 are shown as junctions with the first conducting lines 68. It should further be noted that the plurality of first conducting lines 68 does not physically intersect the plurality of second conducting lines 70. This can be achieved, in accordance with one embodiment of the present invention, by positioning the plurality of first conducting lines 68 and the plurality of second conducting lines 70 in separate planes.

In accordance with a specific embodiment of the invention the two planes are substantially parallel. If desired the space between the planes can be filled with a dielectric plate. The plurality of second conducting lines 70 are drawn with broken lines to indicate that they are in a different plane from the plurality of first conducting lines 68 in this specific embodiment. The switches 66 are shown to be in the same plane as the first conducting lines 68, so that electrical connection between the switches 66 and the second conducting lines 70 is attained by interplane conducting lines (not shown) connected to the terminals 69. Attached to the first conducting lines 68 are switching unit input/output ports 72, which, in the case of a phased array, are connected to radiating elements for radiating and receiving electromagnetic radiation. The phase shift unit 53 has, at one end an input/output port 74 and is connected to the plurality of second conducting lines 70 via interplane conducting lines (not shown) connected to third terminals 76.

In order to compare the number of phase shift elements and switches required when using the phase control device 60 as distinct from the N individual M-stage conventional phase shifters as shown in FIG. 1, it is assumed that in FIG. 6 there are N input/output ports 72 and that there are $2^M$ phase shift elements 62. Hence, there are $2^M$N switches in the phase control device 60. Therefore the saving in the number of switches when using the phase control device 60 as compared to a conventional M-stage phase shifter is $\Delta S=4MN-2^M N$, whereas the saving in the number of phase shift elements is $\Delta P=MN-2^M$. For example, when N=1000 and M=3, then $\Delta S=12000-8000=4000$ and $\Delta P=3000-8=2992$.

Figure 7:
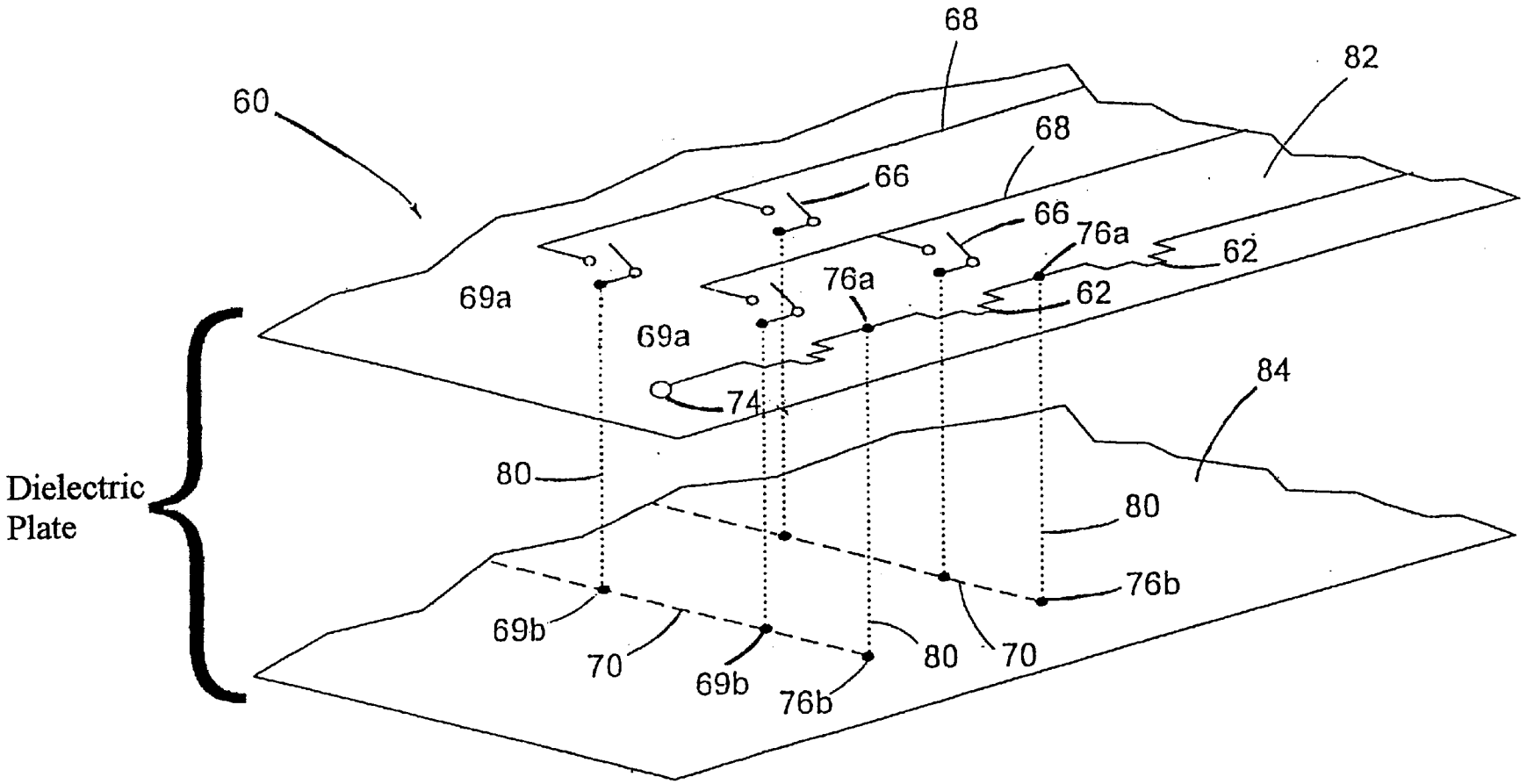
FIG. 7 shows a perspective view of a portion of a phase control device in accordance with one embodiment of the present invention.

FIG. 7 shows a perspective view of a portion of the phase control device 60 in accordance with embodiment of the invention in which the first and second conducting lines 68 and 70, respectively, are in separate planes. Each second terminal 69, shown in FIG. 6, is constituted of a pair of second terminals 69*a*, 69*b* as shown in FIG. 7 connected by the interplane conducting lines 80, shown as dotted lines. The switches 66, the first conducting lines 68 and the phase shift elements 62 along with the phase shift unit input/output port 74, are shown to be located in an "upper plane" 82, whereas the second conducting lines are shown to be located in a "lower plane" 84. The terms "upper" and "lower" are used in reference to the illustration of the phase control device 60 shown in FIG. 7 and do not refer to the actual orientation of the phase control device in practice, which can be any desired orientation. Each third terminal 76, shown in FIG. 6, is constituted of pair of third terminals 76*a*, 76*b* as shown in FIG. 7, connected by interplane conducting lines 80. The upper and lower planes 82 and 84 can be, for example, the opposite faces of a dielectric plate, with the interplane connecting conducting lines 80 passing through holes drilled through the dielectric plate. Although the plurality of first conducting lines 68 and the plurality of second conducting lines 70 are preferably located in separate planes so that there will be no direct contact between them, the switches 66 and phase shift elements 62 can be located either both in the upper plane, as shown, or both in the lower plane, or either one of them in the upper plane and the other in the lower plane. It should be appreciated that the distribution of the various components, i.e. the switches 66, the phase shift elements 62, the conducting lines 64, and the first and second conducting lines 68 and 70, respectively, is not necessarily restricted to the opposite faces of a single dielectric plate and that the phase control device of the invention can also be implemented by disposing the various components on a number of dielectric plates arranged in a piecewise layered formation as is well known in chip design. The distribution of the foregoing components between the different dielectric plates can vary depending on the particular implementation.

Figure 8:
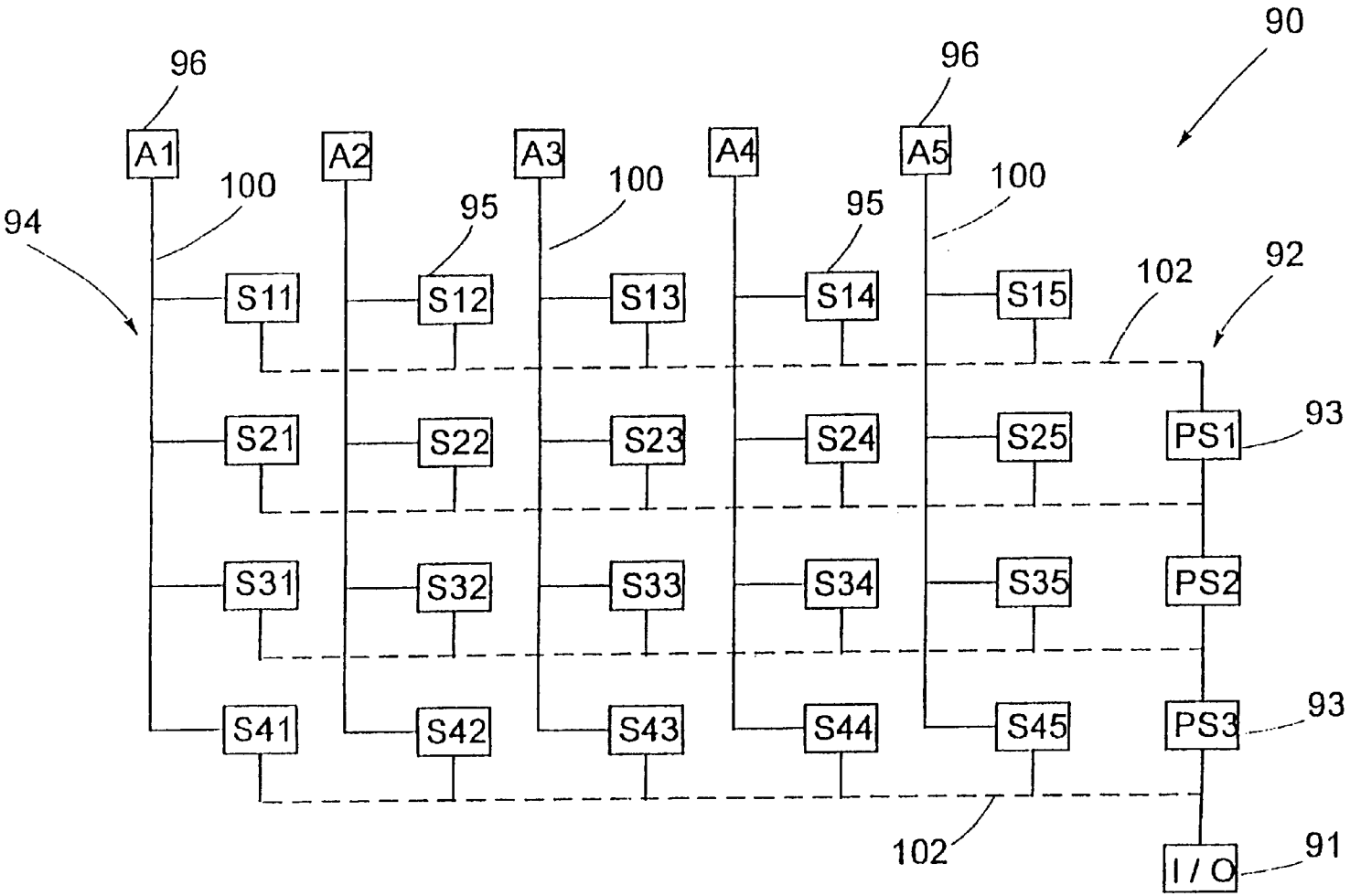
FIG. 8 shows a schematic block diagram of a phase control device.

The operation of the phase control device for a series connected phase shift unit will be illustrated with reference to FIG. 8, showing a schematic block diagram of a phase control device 90 having an input/output port 91, a series connected phase shift unit 92 comprising three phase shift elements 93 designated by PS1, PS2 and PS3, and a switching unit 94 comprising twenty switches 95 designated by SIJ (I=1, . . . ,4; J=1, . . . , 5) and five input/output ports 96 designated by AJ (J=1, . . . , 5). The values of the phase shifts obtained from the phase shift elements will be denoted by psK (K=1, 2, 3), that is, the phase shift element PSI gives rise to a phase shift of ps1, etc.

Consider for the sake of clarity the situation in which a current is inputted at the input/output port 91 (hence becoming, an input port in this mode of operation) and wherein currents with various phases are to be obtained at the input/output ports 96, which in this mode of operation play the role of output ports. In describing the operation of the phase control device it will be assumed that unless stated otherwise all the switches 95 are turned off (i.e. they are in the "off" state), that is, they are open circuited and no current passes through them. In order to apply a current with a phase shift of ps3 to port As, only switch S35 is turned on (i.e., it is changed from the "off" state to the "on" state). Similarly to apply a current with phase ps3 to port A4 only switch S34 is turned on. In other words, in order to apply a current of phase ps3 to output port AJ (J =1, . . . , 5) only switch S3J (J=1, . . . , 5) is turned on. In order to apply a current with a phase ps2+ps3 to port A5, the inputted current has to pass through both phase shift elements PS2 and PS3, hence, only switch S25 is turned on. In general, to apply a current with phase ps2+ps3 to port AJ, then only switch S2J (J =1, . . . , 5) is turned on. Similarly, to apply a current with a phase ps1+ps2+ps3 to port AJ, then only switch S1J (J=1, . . . , 5) is turned on. All the phases are measured relative to the phase of the current at the input port 91. Clearly, the conducting lines 100 and 102 also introduce phase shifts and by varying amounts depending on which switches are turned on. For example, if switch S15 is turned on, the current passes through a relatively small length of the conducting line 102. On the other hand, if switch S11 is turned on, the current passes through the full length of the conducting line 102. Hence, the lengths of the conducting lines connecting the switches to the conducting lines 100 and 102 have to be suitably designed to compensate for the phase shifts introduced by passage of a current through the conducting lines 100 and 102.

Figure 9:
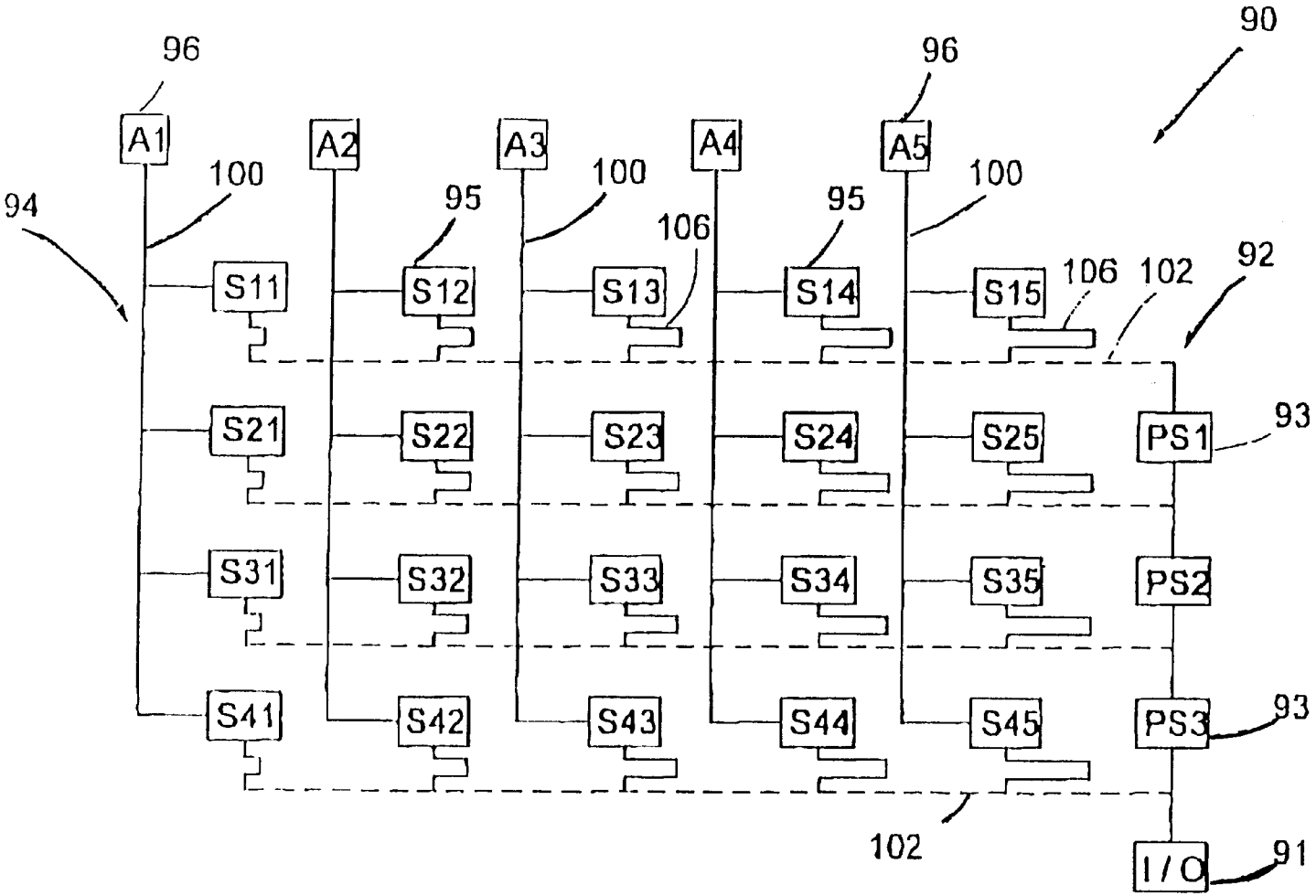
FIG. 9 shows a schematic block diagram illustrating phase compensation for a phase control device in accordance with one embodiment of the present invention.

One possible approach to phase compensation is illustrated schematically in FIG. 9 showing a block diagram of the same phase control device 90 shown in FIG. 8, with the only difference that phase compensation elements 106 have been introduced in the conducting lines connecting the switches. It should be noted that in practice, the locations of the phase compensation elements 106 are not limited to those shown in FIG. 9, the only constraint being that the correct phase compensation be introduced. Although the phase compensation elements 106 have been illustrated as extra path lengths, it will be appreciated that the phase compensation can be effected by any suitable phase shift component. Similarly, suitable phase compensation can also be introduced in FIGS. 6 and 7.

Figure 10:
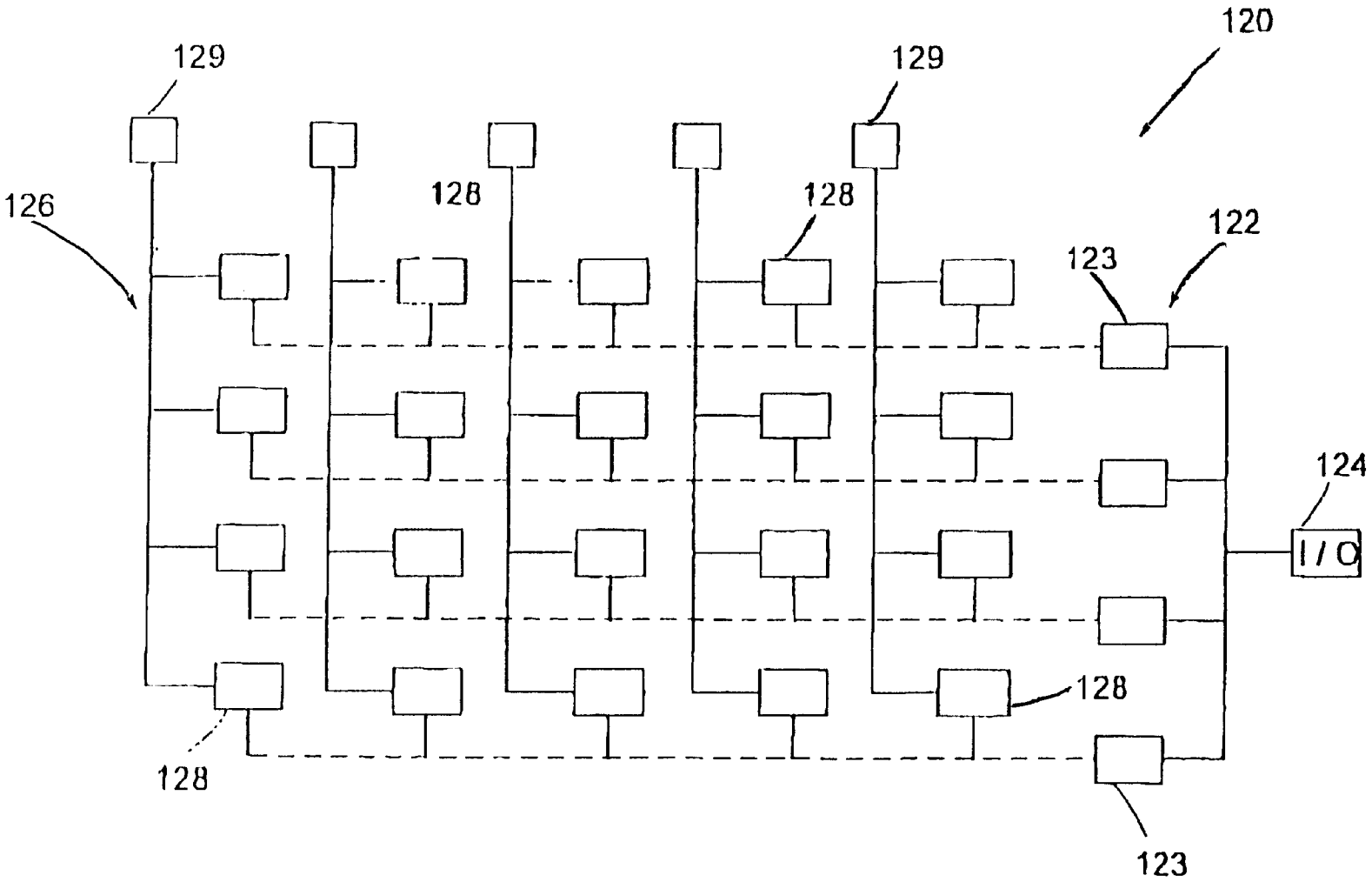
FIG. 10 shows an illustrative block diagram of a phase control device with a parallelly connected phase shift unit.

The phase control device of the invention has been illustrated with a serially connected phase shift unit. However, the phase shift elements can also be parallelly connected. FIG. 10 shows an illustrative block diagram of a phase control device 120 with a parallelly connected phase shift unit 122 having parallelly connected phase shift elements 123 commonly connected to an input/output 124. For the sake of illustration, the switching unit 126 having switches 128 and input/output ports 129, has been taken to be identical to the switching unit 94 in FIG. 8. For the sake of illustration, the extra path lengths used for phase compensation, as described above, have not been shown in FIG. 10. If desired a parallel connection of serially connected phase shift units can be formed. This can be done, for example, for the serially connected phase shift unit shown in FIG. 9 by connecting the input/output ports 91 in parallel.

In situations in which a large number of input/output ports of the switching units of the phase control device is required, it is sometimes useful to use a cascade configuration of phase control devices. In other situations it is useful to connect phase control devices in parallel or in series, or in a combination thereof. To this end a phase control unit is employed from which phase control devices can be constructed. In other words the phase shift elements and the switches may be partitioned into phase control units, the phase shift elements in each phase control unit being electrically interconnected and the switches in each phase control unit being electrically interconnected, only to switches within the same phase control unit and to the phase shift elements thereof.

Figure 11:
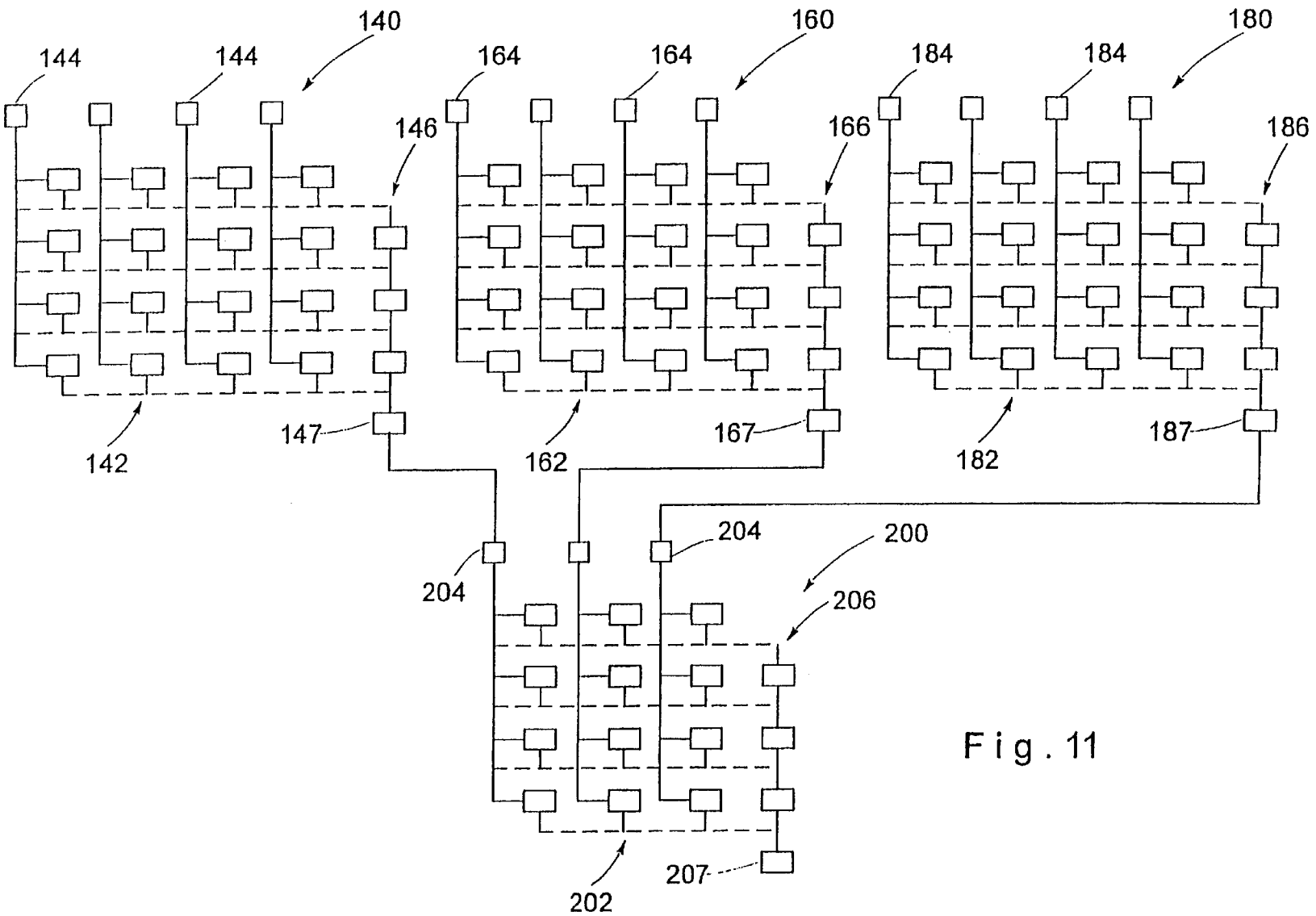
FIG. 11 shows a cascade configuration of serially connected phase control devices.

A cascade configuration of phase control units can comprise phase control units with either serially or parallelly connected phase shift units. FIG. 11 shows an illustrative block diagram of a cascade configuration of phase control units with serially connected phase shift units. Shown are four phase control units 140, 160, 180 and 200, comprising respectively, switching units 142, 162, 182 and 202 having respective input/output ports 144, 164, 184 and 204; and phase shift units 146, 166, 186, and 206 having respective input/output ports 147, 167, 187 and 207. The input/output ports 204 of phase control units 200 are connected to the corresponding input/output ports 147, 167 and 187 of phase control units 140, 160 and 180, respectively, as shown. In the specific application of a phased array antenna the twelve input/output ports 144, 164 and 184 are connected to the radiating elements of the phased array antenna, and input/output port 207 is the radio frequency input/output port of the cascaded switching units. The phase shift units 146, 166 and 186 may or may not be identical, whereas the phase shift unit 206 is, in general, different from each of the phase shift units 146, 166, 186. In one particular application, the phase shift units 146, 166 and 186 give rise to small phase shifts, e.g., 5°, 10° and 15°, whereas the phase shift unit 206 gives rise to large phase shifts, e.g., 30°, 60° and 90°. The cascade configuration of the phase control units make it possible to produce phase shifts that are combinations of the small and large phase shifts.

In another application, the phase shift units 146, 166 and 186 give rise to large phase shifts and the phase shift unit 206 gives rise to small phase shifts. FIG. 11 illustrates only one possibility of a cascade configuration of phase control devices, which clearly is not restricted to that shown and can be with any number of input/output ports and any number of phase control units. Furthermore, FIG. 11 illustrates a single stage cascade configuration which can be straightforwardly generalized to multiple cascade configurations. Other useful embodiments can be constructed, for example, by taking the three phase control units 140, 160 and 180 and electrically connecting them in parallel or in series. These embodiments are not restricted to three control units or to control units with phase shift units serially connected. Furthermore, these embodiments can be constructed from a combination of phase control units with some of them having serially connected phase shift units and some parallelly connected phase shift units. The same is true of cascade formations wherein one or more of the serially connected phase control units shown in FIG. 11 can be replaced by parallelly connected phase control units.

The present invention has been described with a certain degree of particularity, but it should be understood that various alterations and modifications may be made without departing from the spirit or scope of the invention as hereinafter claimed.

What is claimed is:

1. A phase control device capable of providing a plurality of phase values, comprising:

a plurality of electrically interconnected phase shift elements; and a plurality of switches, each switch having a first terminal and a second terminal, the first terminals of said switches being electrically interconnected by a plurality of first conducting lines and the second terminals of said switches being electrically connected to a plurality of second conducting lines, said plurality of switches being electrically connected to said plurality of phase shift elements by means of said plurality of second conducting lines.

2. The phase control device according to claim 1, wherein said plurality of phase shift elements and said plurality of switches are partitioned into phase control units, the phase shift elements in each phase control unit being electrically interconnected and the switches in each phase control unit being electrically interconnected only to switches within the phase control unit and to the phase shift elements of the phase control unit.

3. The phase control device according to claim 2, wherein said phase control units are parallelly connected.

4. The phase control device according to claim 2, wherein said phase control units are serially connected.

5. The phase control device according to claim 2, wherein some of said phase control units are serially connected whereas others are parallelly connected.

6. The phase control device according to claim 2, wherein said phase control units are connected to the switches of a further phase control unit.

7. The phase control device according to claim 6, wherein said plurality of phase shift elements, said plurality of switches and said plurality of first conducting lines are disposed on one side of a dielectric plate; whereas said plurality of second conducting lines are disposed on the opposite of said dielectric plate.

8. The phase control device according to claim 6, further comprising in a piecewise layered formation a plurality of dielectric plates, each having front and rear faces, and wherein said plurality of phase shift elements, said plurality of switches, said plurality of first conducting lines and said plurality of second conducting lines are disposed on the faces of said dielectric plates.

9. The phase control device according to claim 6, wherein said plurality of phase shift elements are serially connected.

10. The phase control device according to claim 6, wherein said plurality of phase shift elements are parallelly connected.

11. The phase control device according to any one of the above claims, wherein said plurality of phase shift elements, said plurality of switches and said plurality of first conducting lines are disposed on one side of a dielectric plate; whereas said plurality of second conducting lines are disposed on the opposite side of said dielectric plate.

12. The phase control device according to claim 11, wherein said plurality of phase shift elements are serially connected.

13. The phase control device according to claim 2, wherein said plurality of phase shift elements, said plurality of switches and said plurality of first conducting lines are disposed on one side of a dielectric plate; whereas said plurality of second conducting lines are disposed on the opposite of said dielectric plate.

14. The phase control device according to claim 2, further comprising in a piecewise layered formation a plurality of dielectric plates, each having front and rear faces, and wherein said plurality of phase shift elements, said plurality of switches, said plurality of first conducting lines and said plurality of second conducting lines are disposed on the faces of said dielectric plates.

15. The phase control device according to claim 2, wherein said plurality of phase shift elements are serially connected.

16. The phase control device according to claim 2, wherein said plurality of phase shift elements are parallelly connected.

17. The phase control device according to claim 1, further comprising in a piecewise layered formation a plurality of dielectric plates, each having front and rear faces, and wherein said plurality of phase shift elements, said plurality of switches, said plurality of first conducting lines and said plurality of second conducting lines are disposed on the faces of said dielectric plates.

18. The phase control device according to claim 17, wherein said plurality of phase shift elements are serially connected.

19. The phase control device according to claim 1, wherein said plurality of phase shift elements are serially connected.

20. The phase control device according to claim 1, wherein said plurality of phase shift elements are parallelly connected.

21. The phase control device according to claim 1 wherein said first and second conducting lines are connected to said switches such that each of said second conducting lines is connectable to one of said first conducting lines only by closing the respective switch.

22. The phase control device according to claim 1 wherein said first and second connecting lines are associated with said plurality of switches in such a manner that when all of said switches are open, none of said first conducting lines is connected to any of said second conducting lines.

* * * * *